US008389453B2

(12) United States Patent
Thomson

(10) Patent No.: US 8,389,453 B2
(45) Date of Patent: Mar. 5, 2013

(54) TETRAFLUOROBORATE COMPOUNDS, COMPOSITIONS AND RELATED METHODS OF USE

(75) Inventor: Rod Thomson, Burlington (CA)

(73) Assignee: Vitech International, Inc., Edgerton, WI (US)

( * ) Notice: Subject to any disclaimer, the term of this patent is extended or adjusted under 35 U.S.C. 154(b) by 0 days.

(21) Appl. No.: 12/291,285

(22) Filed: Nov. 7, 2008

(65) Prior Publication Data

US 2009/0176689 A1 Jul. 9, 2009

Related U.S. Application Data

(60) Provisional application No. 61/002,246, filed on Nov. 7, 2007.

(51) Int. Cl.
*C11D 3/20* (2006.01)

(52) U.S. Cl. ..... 510/175; 510/395; 134/2

(58) Field of Classification Search ..... 510/395, 510/175; 134/2
See application file for complete search history.

(56) References Cited

U.S. PATENT DOCUMENTS

| | | | | |
|---|---|---|---|---|
| 5,234,466 | A | 8/1993 | Sargent et al. | |
| 5,616,151 | A | 4/1997 | Sargent et al. | |
| 5,672,279 | A | 9/1997 | Sargent et al. | |
| 6,060,122 | A * | 5/2000 | Rossmaier | 427/327 |
| 6,380,410 | B1 | 4/2002 | Oftring et al. | |
| 2006/0079424 | A1 | 4/2006 | Perry | |
| 2006/0234901 | A1 | 10/2006 | Scheuing et al. | |
| 2007/0000523 | A1 | 1/2007 | Kim et al. | |
| 2007/0179072 | A1 * | 8/2007 | Rao et al. | 510/175 |

FOREIGN PATENT DOCUMENTS

| | | |
|---|---|---|
| EP | 1813667 | 8/2007 |

OTHER PUBLICATIONS

Supplementary European Search Report, Application No. EP 08 84 6620, issued Dec. 19, 2011.

* cited by examiner

*Primary Examiner* — Mark Eashoo
*Assistant Examiner* — M. Reza Asdjodi
(74) *Attorney, Agent, or Firm* — Reinhart Boerner Van Deuren s.c.

(57) ABSTRACT

Tetrafluoroboric acid and an organic nitrogenous base, related compounds and compositions, as can be used in conjunction with various methods of cleaning and/or the treatment of substrate surfaces.

4 Claims, No Drawings

TETRAFLUOROBORATE COMPOUNDS, COMPOSITIONS AND RELATED METHODS OF USE

This application claims priority benefit from application Ser. No. 61/002,246 filed Nov. 7, 2007, the entirety of which is incorporated herein by reference.

BACKGROUND OF THE INVENTION

Acids perform a wide variety of unique cleaning functions in both industrial and domestic settings. This includes removal of metal based oxides and scales such as rust and calcium carbonate. In addition, certain acids have been used to remove metal oxides and complex silicate based materials that leave a dull look to a surface. Some of these applications include, for example, atmospheric fallout removers in the automotive field, as well as the brightening of aluminum on truck trailers, and removal of road film in touchless vehicle wash.

Typically, in order to achieve effective results in a timely fashion in most of these applications, strong mineral acids such as hydrochloric or sulfuric acid are used, sometimes in conjunction with milder, weak acids such as citric, oxalic or glycolic acid. These acids can be useful in the removal of iron oxides and/or calcium carbonate scale, as well as being a first step in touchless vehicle washing. Other strong organic acids, such as alkane sulfonic acids, can also be useful but are less effective than mineral acids at rust removal and typically require fairly high use levels impacting cost.

In addition, concentrated cleaners containing these strong mineral acids are dangerous to use, often producing fumes that cause choking or more complicated and sometimes serious respiratory problems. Further, contact with skin can result in irritation of the skin to, in some cases, severe burning—depending upon the composition of the cleaner. The mechanism of the burns can involve acid catalysed hydrolysis of tissue (most common) and/or oxidative decomposition, depending upon the acid (e.g. nitric, sulfuric). As such, these complicating factors require the material to be classified as corrosive, which impacts the labeling of the product, the transportation mode available for the product, and therefore, at use cost.

Furthermore, in the case of the cleaning of aluminum truck trailers, a number of these acids have been employed to perform this function but with very limited success. There are two issues in cleaning these types of trucks, including both the removal of soils and road film, in addition to the removal of aluminum oxide which gives the metal a dull look. The clear leader in effecting both cleaning attributes, which is almost unique in the field, is hydrofluoric acid (HF). This acid is able to dissolve most any metal oxide, including aluminum oxide, as well as complex silicates. In the case of aluminum trailers, it leaves a very bright surface, almost white when used in conjunction with sulfuric acid.

Although HF has appeared to have unique properties, there are many issues regarding its use that make it undesirable. For example, HF can irreversibly etch glass which could render a windshield unusable due to opacification of the glass. In addition, HF can also "burn" the aluminum if left for too long on the surface. This phenomenon becomes more likely when cleaning is performed in hot weather. Burns result in a darkening (black or brown) of the surface. These can only be removed by polishing the metal, a time consuming and expensive solution. Furthermore, pitting of the surface can take place with overexposure. This is an irreversible phenomenon that will affect the appearance of the trailer thereafter.

Most notably, there are severe health and safety issues associated with the use of HF for the worker. Although it is a relatively weak acid with pKa in the region of 3.5, it is nonetheless extremely dangerous. HF will pass through the skin and can cause fluorosis, hypocalcemia and hypomagnesia. These are all very serious medical issues, and in severe cases, can lead to death. For example, death has been reported from spills of concentrated HF (48%) on as little as 2.5% of body surface area (relates to workers preparing cleaners). Even at low concentrations (less than 3%), HF exposure can lead to serious health issues (relates to workers in the field). One of the reasons that this can take place is the delayed action of HF in the body at these low concentrations. As it is not a strong acid, tissue is not damaged via a hydrolysis based mechanism which produces immediate pain. Symptoms may not appear for several hours, resulting in deeper penetration into the body and more severe burns requiring more invasive treatment strategies. In the US, there are more than 1,000 cases of medical emergency treatments due to HF exposure reported annually.

A further concern associated with long term exposure to HF is its propensity to bioaccumulate in human tissue. Even very low levels of HF that would produce no acute symptoms can cause serious health problems due to the very slow elimination from the body. The primary concern is embrittlement of the bones which has obvious, negative ramifications for the worker.

Attempts to minimize the dangers associated with HF have been made through the use of compounds such as ammonium bifluoride (ABF). This compound is the reaction product of one mole of ammonia and two moles of HF. The result is a solid material that is odorless, but nonetheless still very dangerous as there is still free HF associated with the product. Contact with the skin can still result in the same health issues found with HF (MSDS denotes a health rating of 4, extreme (life threatening), so it is really not a safe alternative.

Clearly, there remains a strong need to find a non-corrosive alternative for cleaning with HF. One technique that has been shown to minimize both health and safety as well as environmental problems associated with the use of general acid cleaning agents, has been the formation of "acid salts". This involves the reaction of a strong mineral acid, such as hydrochloric acid, with a very weak base such as urea, which produce salts with extremely low pKa values, such that the salt still behaves as a strong acid. Accordingly, the salt formation creates a non-fuming product, and when a proper mole ratio is used, corrosivity of the skin can be greatly reduced. Urea hydrochloride, as more fully described in U.S. Pat. No. 5,672,279, is one such example. This compound however, although a safe and effective acid for descaling, suffers badly due to its aggressiveness to aluminum (burns the metal) and staining of metals such as stainless steel—severely limiting its use in transportation cleaning applications.

Other acid salts such as are formed from alkanesulfonic acids have been shown to be safe on aluminum and other metals such as stainless steel. However, they do not brighten aluminum in a timely fashion and typically require high use levels which impact costs significantly. This limits their use practically in at least this field.

Intuitively, one would postulate that formation of a urea HF salt would be an effective means to achieve improved safety with HF. However, given the relatively weak acid nature of HF (pKa 3.4), it is not possible to quantitatively produce a stable salt from the reaction of HF and urea. In essence, there will be some urea:HF salt formed in solution, but there will still be free HF in solution at any given time. A stronger base such as ammonia is required to quantitatively form a fluoride salt, however, the reaction product will be neutral and ineffective as a cleaner.

There remains a need to produce a safe product that will be effective as an HF-like cleaner. Such a product or composition should be effective at dissolving metal oxides (especially aluminum oxide) as well as complex silicates. Other favourable properties would include ability to rapidly solubilize iron oxides and calcium based scales. Mineral acids that can quantitatively form urea salts such as the halide series (HCl, HBr, HI), sulfuric and alkanesulfonic acids cannot meet these criteria, nor can the typical organic acids such as citric and glycolic acids. Nitric acid is, likewise, deficient, as a stable urea salt is unavailable due to oxidative degeneration.

SUMMARY OF THE INVENTION

In light of the foregoing, it can be an object of the present invention to provide various non-corrosive (with respect to skin) acid cleaning compositions and/or methods for their preparation and/or use, thereby overcoming various deficiencies and shortcomings of the prior art, including those outlined above.

It can be an objective of the present invention to provide one or more cleaning compositions and/or systems comprising tetrafluoroboric acid, or as is commonly referred to fluoboric acid, ($HBF_4$) alone or in combination with an organic nitrogenous base component (e.g., the corresponding tetrafluoroborate salt), and optionally an acid inhibitor, for performance equivalent or comparable to HF (and superior cleaning relative to other traditional acids) in a number of cleaning applications.

It can be a related objective of the present invention to provide such a cleaning composition that is non-irritating and/or non-corrosive to the skin, and non-corrosive to mild steel and therefore can be shipped DOT non-regulated by ground in the United States, at a significantly lower transportation cost as compared to conventional acid cleaning products including HF.

It can be a related objective of the present invention to provide tetrafluoroboric acid-based, highly-effective and worker-safe cleaning compositions that can compare well in performance to HF and reduce, if not eliminate, risks associated with fluorosis, hypocalcemia or hypomagnesia or any of the unique medical conditions that arise from absorption of free fluoride into the body. Further, such compositions are not known to bioaccumulate, thereby minimizing or eliminating longer term health effect issues.

It can be, accordingly, an objective of the present invention to demonstrate effective removal of aluminum oxides in brightening of aluminum, such as can be found in transportation trucks and trailers. It is a further objective of the present objective to demonstrate that this brightening can occur with improved safety and without regard for "burning" of the aluminum as is typical with HF and traditional mineral acids or their urea salts. It is, likewise, an objective to show that these effects can be achieved without regard for etching of glass.

It can be, accordingly, an objective of the present invention to remove scale, road film, rust or other unwanted build-up or residue, such as water-insoluble metal salts (e.g., carbonates), from a surface and/or a substrate using such a tetrafluoroboric acid composition.

It can also be an objective of the present invention, in conjunction with one or more of the preceding objectives, to provide one or more of the inventive compositions formulated and/or as provided with an appropriate delivery system, as would be understood in the art, to achieve desired performance parameters.

Other objects, features, benefits and advantages of the present invention will be apparent in this summary and descriptions of certain embodiments, and will be readily apparent to those skilled in the art having the knowledge and experience in the area of cleaning compositions for a particular end-use cleaning application (e.g. industrial and transportation versus household cleaning applications and/or type of surface to be cleaned, metal, ceramic, fiberglass, plastic, glass, etc.). Such objects, features, benefits and advantages will be apparent from the above as taken in conjunction with the accompanying examples, data and all reasonable inferences to be drawn therefrom.

In light of the foregoing, the present invention, in part, can be directed to a compound comprising tetrafluoroboric acid and at least one organic nitrogenous base component, e.g., without limitation, the acid-base reaction product thereof, tetrafluoroborate salt of such a base component and/or a composition comprising such a compound. The amount of tetrafluoroboric acid can vary depending upon desired performance properties or end use application, with various solution concentrations commercially-available.

The compounds or compositions of the present invention can be provided in conjunction with a fluid or aqueous medium and can be provided in a ready-to-use form. Alternatively, depending on the nature of use and application, such a compound or composition can be in form of a concentrate containing a higher proportion of a tetrafluoroboric acid-base system, the concentrate being diluted with water or another solvent or liquid medium before or during use. Such concentrates can be formulated to withstand storage for prolonged periods and after such storage be capable of dilution (e.g., with water) in order to form preparations which remain homogeneous for a sufficient time to enable them to be applied by conventional methods. After dilution, such preparations may contain varying amounts of the active acid-based cleaning composition, depending upon the intended purpose or end-use application.

The compositions of the present invention can be applied, formulated or unformulated, directly to a surface to be treated, or they can be sprayed on, dusted on or applied as a cream, paste or emulsion formulation. Compositions to be used as sprays may be in the form of aerosols wherein the formulation is held in a container under pressure of a propellant, e.g. fluorotrichloromethane, dichlorodifluoromethane or another propellant known in the art.

Without limitation, certain embodiments of the present invention can utilize an organic nitrogenous base component, in an about 0.5 to about 5.0 molar ratio with respect to an acid concentration. However, the relative amounts and/or concentrations of the tetrafluoroboric acid component and base component in the compositions of the present invention can vary widely, depending on the desired function of the composition and/or the required cleaning activity, as demonstrated in the examples that follow. As such, the weight ratios and/or concentrations utilized can be selected to achieve a composition and/or system that is non-corrosive and/or non-irritating to the skin, non-fuming and safe from a health and safety viewpoint.

A non-limiting embodiment of this invention can comprise a compound or composition comprising tetrafluoroboric acid and urea, and/or use thereof. Consistent with the broader aspects of the present invention, one or more substantially equivalent bases, in terms of basic strength, or compounds imparting basic functionality may be used in place of or in combination with urea. Examples of other such base components include, but are not limited to, biuret (urea dimer) and other soluble urea compounds, alkyl urea derivatives, alkanolamines, including triethanolamine, diethanolamine, monoethanolamine and HO-[(alkyl)O]$_x$—CH$_2$)$_y$NH$_2$, including HO—[(CH$_2$)$_x$O]—CH$_2$)$_x$NH$_2$; wherein the alkyl group can vary within the moiety, wherein x is 1-8 (which can vary within the moiety) and y is an integer of 1 to 40; alkylamines, dialkylamines, trialkylamines, alkyltetramines, polymers with amino or (alkyl or aryl)amino substituent groups, polymers with nitrogen-containing heterocyclic groups, acrylamide, polymers and copolymers of acrylamide, vinyl pyrollidone, polyvinyl pyrollidone, copolymers of vinyl pyrollidone, methacrylamide, polymethacrylamide, copolymers of acrylamide, ammonia and combinations thereof. Such bases may also include one or more of those described in U.S. Pat. Nos. 5,234,466, 5,616,151 and/or 5,672,279 to Sargent et al., the entirety of each are incorporated herein by reference.

In certain other embodiments, the cleaning compositions of the present invention can include one or more acid and/or corrosion inhibitor components. For example, it is possible and beneficial to combine tetrafluoroboric acid and sulfuric acid with an appropriate quantity of urea to produce a mixed acid system that is beneficial in transportation pre-soak cleaners, although the mix of acids is not limited to sulfuric acid but can include any of the mineral or organic acids previously mentioned. One particular acid that can also be used in conjunction with tetrafluoroboric acid is fluorosilicic acid, with consideration, however, of toxicity and glass etching issues. A corrosion inhibitor employed in the present invention can be any one or more corrosion inhibitors known to those skilled in the art and/or specifically dictated by several factors including, but not limited to, the type of surface to be treated (metals, such as, aluminum, steel, iron, brass, copper, ceramics, plastics, glass etc.), the tetrafluoroboric acid concentrations thereof included in the system, system pH, the inhibitor efficiency, inhibitor solubility characteristics, desired length of exposure of the system to the surface, environmental factors, etc. Accordingly, such a corrosion inhibitor can be any acid inhibitor known to one skilled in the art, including but not limited to, sulfonate, carboxylate, amine, amide and borated-based inhibitor compounds. In certain embodiments of the present invention, an acid inhibitor can be an amine based inhibitor, in a suitable concentration (e.g., without limitation) from about 0.05 to about 0.3% weight percent. (Such amine based inhibitor compositions can be of the type sold under the registered trademark Armohib® by Akzo Nobel or its licensees).

Likewise, such compositions can optionally comprise one or more nonionic, anionic, cationic or amphoteric surfactants or a mixture thereof to improve both performance and economy. The type of surfactant selected can vary, for example, depending on the nature of the particular conditions of use (i.e. type of residue to be removed or type of surface), and/or the nature of the solvent (aqueous versus a less polar solvent such as an alcohol or other organic solvent). In certain embodiments of the present invention, a composition can comprise a nonionic surfactant such as WinSurf/Videt Q3™ surfactant, which demonstrates rapid wetting due to the excellent, associated dynamic surface tension profile (available from Win Chemicals Ltd. and Vitech International, Inc.).

Depending on the type of end-use application, the compositions of the present invention can also comprise any other required components including, but not limited to, solid or liquid carriers to facilitate application, surfactants, thickeners, thixotropic agents, penetrating agents, stabilizers, brighteners, as will be well known to those skilled in the art.

Accordingly, in part, the present invention can be a multipurpose, noncorrosive cleaning composition or system comprising tetrafluoroboric acid, a base component and a corrosion inhibitor component, as can be applied to a surface. Such a composition can, without limitation, provide a high activity product that can uniquely and surprisingly possess one or more of the following combined features: (1) no skin sensitivity/corrosivity after four hour exposure, non irritant; (2) non-corrosive to mild steel as per standard Department of Transportation (DOT) test methods; (3) capable of brightening aluminum and performing acts of cleaning traditionally associated with HF; (4) good oral toxicity with none of the severe health effects associated with HF or free fluoride exposure through the skin; (5) extremely low odor profile; (6) non fuming; and/or (7) non staining with respect to stainless steel and brass. In view of the first two features and unlike conventionally used acid cleaning compositions, the compositions/systems of the present invention can be shipped non regulated via ground in the United States and potentially in Canada with a specific exemption from Part 14 of the TDG regulations.

The inventive compounds and compositions, including those embodiments described in conjunction with such optional components, are commercially-available from Vitech International, Inc. of Edgerton, Wis., USA and Win Chemicals Ltd. of Burlington, Ontario, Canada.

Therefore, this invention can also be directed to a method of treating or cleaning a surface with a tetrafluoroboric acid-base compound or a corresponding composition, to remove or affect accumulation of surface contaminants. Such a method can comprise providing one or more of the compounds and/or compositions of this invention, including but not limited to those specifically described herein; and contacting a surface or a substrate with such a composition. A cleaning compositions provided in conjunction with the present method can comprise, as described herein and illustrated through several non-limiting embodiments, tetrafluoroboric acid in combination with any organic nitrogenous base component and/or a corresponding tetrafluoroborate salt compound and/or composition. It can also contain any other appropriate mineral or organic acid in conjunction with a weak base. The surface can be contacted with the composition for a given period of time and/or to effect a specific level of cleaning, descaling and/or brightening activity on the surface. Accordingly, the invention can include, in part, a composite cleaning system comprising a substrate having at least a portion containing a tetrafluoroboric acid composition disposed thereon, wherein cleaning activity is effected on the portion of the substrate coated with the composition. The types of substrates contemplated in conjunction with this invention include, without limitation, a range of automotive vehicles and related trailers and tanks and corresponding surfaces—of materials which can include, but are not limited to, metals, such as aluminum, iron, copper, steel alloy or brass alloy, together with other substrates of metal, ceramic, tile, stone, brick, glass, fiberglass, wood and/or composites thereof.

A tetrafluoroboric acid-base compound or cleaning composition can be any one or more of those described herein, and can be disposed and/or applied to one or more surfaces of a substrate using any means known to those skilled in the art. For instance, without limitation, such a compound or composition can be applied to an automotive vehicle substrate surface with or by incorporation into a vehicle wash system. Regardless, a substrate can be coated with the composition such that the composition physically, mechanically or otherwise interacts with and/or adheres to the substrate. More specifically, a tetrafluoroboric acid cleaning composition can be formulated, consistent with the teachings of the invention, to ensure sufficient adhesion of the composition to the substrate during use of the system. Such formulations can depend on the substrate chemical composition and surface properties, the specific base component used in the cleaning composition, inclusion of rheology modifiers and/or the wettability/surface tension between the substrate and the cleaning composition.

Accordingly, the present invention can be a method of using a tetrafluoroborate salt of an organic nitrogenous base or a corresponding composition to treat a substrate and/or remove or affect accumulation of contaminants on a surface thereof. Such a method can include providing an effective amount of a cleaning compound or composition comprising a tetrafluoroborate salt of such a base component; and treating or contacting the substrate with such a cleaning compound or composition. Such a method can include contacting an automotive vehicle or other substrate with a cleaning compound or composition, in an amount and/or for a length of time at least partially sufficient to at least partially remove at least one contaminant and/or effect a desired level of cleaning activity on the surface.

The cleaning compounds and compositions for use in the present methods can be any one or more of those described herein—and can be used to clean, remove build-up and/or residue from the substrate. The specific components of the cleaning composition can be selected as a matter of design choice, and therefore, can depend on the type of build-up (e.g., metal carbonates and oxides including aluminum oxide, complex silicates, metal salts, proteinaceous materials, road film, brake dust and dust, including silicious materials, carbonaceous, both organic and inorganic materials, minerals, etc.), stains, rust, lime, soap scum and/or the type of substrate to be treated.

Such a method, and compound or composition used in conjunction therewith, can further include providing at least one corrosion inhibitor component in an amount effective to provide a sufficient level of acid inhibiting activity for the type of substrate to be treated. Such a method, compound and/or composition can also include incorporation of a surfactant component the system, depending on the type of base component utilized, the type of build-up and/or type of surface to be treated.

Consistent with the broader aspects of the present invention, the invention can also comprise a kit for treating a hard surface including providing a first enclosure containing a certain and/or an effective amount of tetrafluoroboric acid component, and a second enclosure containing an amount of base component sufficient to form a salt of the tetrafluoroboric acid component when the base component is contacted with the tetrafluoroboric acid component. Optionally, one of the first and the second enclosures can include a corrosion inhibitor, and optionally, at least one surfactant component. Such a kit, in certain embodiments, can be provided in an anhydrous form for the base portion only.

Alternatively, in part, this invention can be directed to a non-electrochemical, non-electroplating method for the treatment or cleaning of a substrate or surface in the transportation industry, to remove contaminants therefrom. Such a transportation-related method can comprise providing an automotive vehicle surface or vehicle component surface comprising one or more contaminants thereon, such contaminants including but not limited to a road film, a metal oxide or carbonate, a silicon oxide, brake dust, and combinations thereof; and contacting such a substrate/surface with tetrafluoroboric acid in an amount at least partially sufficient to remove at least one such contaminant therefrom. Such a surface/substrate can be of the sort described elsewhere herein, and contacted with tetrafluoroboric acid for a given period of time and/or to effect a certain level of cleaning, descaling and/or brightening activity.

In various non-limiting embodiments, tetrafluoroboric acid can be provided in an aqueous or another fluid medium. In certain such embodiments, such a medium can comprise one or more optional components of the type described herein—including, but not limited to, one or more corrosion inhibitors, stabilizers, thickeners and combinations thereof, such component(s) limited only by acid stability of the resulting composition. tetrafluoroboric acid and related compositions can be formulated as needed for a particular cleaning system and applied to an automotive vehicle/component surface, such formulation and/or application as described herein or as would otherwise be known to those skilled in the art made aware of this invention.

With respect to in the compounds, compositions and/or methods of the present invention, the base components can suitably comprise, consist of or consist essentially of any of those base components described herein or as otherwise would be understood by those skilled in the art made aware of this invention. Each such compound or composition, or base component thereof, is compositionally distinguishable, characteristically contrasted and can be practiced in conjunction with the present invention separate and apart from another. Accordingly, it should be understood that the inventive compounds, compositions and/or methods, as illustratively disclosed herein, can be practiced or utilized in the absence of any one compound and/or base component thereof, which may or may not be disclosed, referenced or inferred herein, the absence of which may or may not be specifically disclosed, referenced or inferred herein.

EXAMPLES OF THE INVENTION

The following, non-limiting examples and data illustrate various aspects and features relating to the compounds, compositions and/or methods of the present invention, including the formulation of representative compositions for the applications shown. In comparison with the prior art, the present compositions and methods provide results and data which are surprising, unexpected and contrary thereto. While the utility of this invention is illustrated through the use of several compositions and formulations, which can be used therewith, it will be understood by those skilled in the art that comparable results are obtainable with various other compounds and compositions, incorporating other acids and/or base components, as are commensurate with the scope of this invention.

Example 1A

Tetrafluoroboric acid is commercially available (e.g., from Aldrich Chemical) and can be synthesized using any method known to those skilled in the art. For example, tetrafluoroboric acid is typically synthesized via the action of sulfuric and boric acid upon fluorspar ($CaF_2$), as will be well known to those skilled in the art. However, given the very high bond strength associated with the boron:fluorine bond, tetrafluoroboric acid can be synthesized from virtually any source of free fluoride and boric acid. For example, an embodiment of the invention can include in-situ generation of tetrafluoroboric acid from the mixing of four mole equivalents of HF with one mole (or in slight excess) equivalent of boric acid, in the presence of an appropriate quantity of weak base such as urea. This feature also supports the absence of any free HF in tetrafluoroboric acid to a value of less than 1 mg/L based on fluoride. It further explains the non-etching behaviour of tetrafluoroboric acid with respect to glass.

Tetrafluoroboric acid is a very strong acid with pKa of approximately −3, about 10 times stronger in acidity than hydrochloric acid and, therefore, an excellent candidate for salt formation with a very weak base such as urea. tetrafluoroboric acid has found wide acceptance in electrochemical processes due to its ability to brighten aluminum. It further is used electroplating baths and as a catalyst in organic chemical synthesis or stabilizing anion in the formation of diazonium salts. It is relatively toxic by ingestion ($LD_{50}$ of 100-464 mg/kg, based on 48% tetrafluoroboric acid) but has been shown to eliminate quickly from the human body via excretion through the urine. It is water white and low odour, however, it is both corrosive to skin and mild steel and therefore has seen very limited use in cleaning applications. As such, tetrafluoroboric acid can be used in the inventive cleaning compositions of the present invention without the corrosivity issues conventionally associated with use of tetrafluoroboric acid alone. Furthermore, toxicity associated with tetrafluoroboric acid is reduced with inventive cleaning compositions of the present invention to a value of approximately 1340 mg/kg ($LD_{50}$ based on 48% equivalent percent of tetrafluoroboric acid).

Example 1B

A wide range of formulations can be prepared in accordance with this invention. Using procedures analogous to those described in the examples that follow, the present methods are effected, in accordance with this invention, using compositions comprising various combinations of the following non-limiting tetrafluoroboric acid (A) and base (B) components.

TABLE 1

| Cleaning Compositions | |
|---|---|
| tetrafluoroboric acid component (A) | tetrafluoroboric acid, 1-48% or higher concentration if available |
| Base Component (B) | Urea, biuret (urea dimer) and other soluble urea compounds, alkyl urea derivatives, alkanolamines, including triethanolamine, diethanolamine, monoethanolamine and HO—[(alkyl)O]$_x$—CH$_2$)$_y$NH$_2$, including HO—[(CH$_2$)$_x$O]—CH$_2$)$_x$NH$_2$; wherein the alkyl group can vary within the moiety, wherein x is 1-8 (which can vary within the moiety) and y is an integer of 1 to 40; alkylamines, dialkylamines, trialkylamines, alkyltetramines, polymers with amino or (alkyl or aryl)amino substituent groups, polymers with nitrogen-containing heterocyclic groups, acrylamide, polymers and copolymers of acrylamide, vinyl pyrollidone, polyvinyl pyrollidone, copolymers of vinyl pyrollidone, methacrylamide, polymethacrylamide, copolymers of acrylamide, ammonia and combinations thereof. |

Such cleaning combinations can be prepared, as would be understood by those skilled in the art—without undue experimentation—as provided herein or using straight forward modifications of known techniques, over a wide range of concentrations of acid component and base component. For instance, without limitation, tetrafluoroboric acid can be used at a concentration of about 0.5 to about 75 weight percent; regardless, urea as a representative base can be used at a concentration of about 0.5 to about 35 weight percent of a corresponding composition. Such components are preferably provided in amounts sufficient to provide a salt of the tetrafluoroboric acid component. Likewise, cleaning compositions useful in conjunction with the present methodologies can comprise a range of corrosion inhibitors and/or surfactant components to achieve a desired cleaning activity, depending on the type of substrate or build-up to be removed and/or the given end-use application.

Example 1C

A wide range of formulations can be prepared in accordance with this invention. The order of addition and the range of use levels can be but is not limited to that presented below in Table 2. Normal precautions must be taken when handling the raw materials in each case. After addition of each component into solution, thorough mixing is effected, ensuring that all solid materials are dissolved.

TABLE 2

| Raw Material | Order of Addition | Range of Use |
|---|---|---|
| tetrafluoroboric acid (48%) | 1 | Quantity Sufficient |
| Urea | 2 | About 0.5-about 5.0 mole ratio of tetrafluoroboric acid |
| Armohib ® 28 inhibitor | 3 | About 0.05-about 0.3% |

Production of the raw material (urea tetrafluoroborate) may also be prepared in the following fashion as shown in Table 3.

TABLE 3

| Raw Material | Order of Addition | Range of Use |
|---|---|---|
| Hydrofluoric acid (48%) | 1 | Four mole equivalent |
| Boric acid | 2 | One mole equivalent or In excess |
| Urea | 2 | About 0.5-about 5.0 mole ratio of boric acid |
| Armohib ® 28 inhibitor | 3 | About 0.05-about 0.3% |

A useful urea tetrafluoroborate cleaning composition can comprise the composition presented in Table 3.

TABLE 4

| Useful System of the Present Invention | | |
|---|---|---|
| Raw Material | Order of Addition | Use Level |
| tetrafluoroboric acid (48%) | 1 | 70.45% |
| Urea | 2 | 29.40% |
| Acid Inhibitor | 3 | 0.15% |

The urea is added into the tetrafluoroboric acid which is a 48% solution in water. Once all of the urea is dissolved, the acid inhibitor is added with mixing. The acid inhibitor that was used is Armohib® 28, an amine based acid inhibitor.

Note that salt formation need not be limited to reaction of tetrafluoroboric acid and urea, but may also include other weak bases such as biuret (urea dimer), alkyl urea derivatives and polymeric components with weak base functionality. Other acid inhibitors for use in compositions for cleaning steel, aluminum, brass and/or copper may also be used.

Example 2

Transportation Cleaning

This an application where significant advantage may be gained both from the personal safety and surface safe characteristics of the invention. Surface safe is defined as application of the formulation without concern for burning of metals or etching of glass. HF will both burn metals and etch glass if applied at either too high a concentration, left in contact for too long or applied at too high a temperature.

This application includes transportation cleaners for the washing of trucks and cars using touchless wash systems. As referenced earlier, aluminum trucks oxidize in air and get a dull look as a result. Very few acids are able to remove this oxide. HF is the predominant choice of the prior art and it has been considered to be unique, until now, in its ability to create a bright white look, typically using formulae containing mixtures of HF and sulfuric acid.

Removal of road film is a critical function in effective vehicle washing. Road film is known in the art to be a complex matrix that forms from the deposition of airborne materials that include dust (includes silicious materials), carbonaceous (both organic and inorganic) materials and minerals from acid rain fallout. Acids are frequently employed as a first step in an attempt to alter the matrix and simplify cleaning (typically via a second step alkaline cleaner and rinsing). The problem that needs to be managed carefully involves both "acid burning" of metal parts such as aluminum rims and chrome (applies to acids in general) and glass etching (applies to HF use). A number of acids have been shown to be effective in this road film removal application, but none until now have been shown to match HF. This is very likely due to the structure of the road film being based on complex silicate chemistry, which is near intractable for non HF based formulations.

Wheel cleaning is another important yet very difficult application in transportation cleaning. Labour is always a key component in cost and car detailers and car wash operators continually look for ways to avoid physical scrubbing of a wheel in the cleaning process. Brake dust is known in the art as a complex inorganic matrix that builds up on all wheels, especially those where disc brakes are used. Until now, HF has once again been the best performing product as it is well suited to modify the complex inorganic matrix into something that can be easily rinsed off with pressurized water. HF and ABF are both used in both industrial and retail based wheel cleaners. Unfortunately, there have been incidents reported of injury and even death in children as they have been exposed to these products.

TABLE 5

Formulae Tested for Aluminum Brightening Performance

| Control | Invention |
|---|---|
| 10% Hydrofluoric acid (48%) | 15% tetrafluoroboric acid (48%) |
| 20% Sulfuric acid (conc) | 3.0% WinSurf Q3 ™ surfactant |
| 20% Phosphoric acid (85%) | 5% Urea |
| 3.0% Alcohol ethoxylate | 0.03% Armohib 28 ® inhibitor |
| 2.0% Alpha Olefin Sulfonate | QS Water (i.e., sufficient water for |
| QS water | component percentages) |
| Apply at 8:1 | Apply at 5:1 |

Application at 5:1 of the invention based formula did not result in any damage to the vehicle (no pitting) and brightened the aluminum as well as the control. A longer dwell time was required to achieve this effect, on the order of 25% longer. However, the control did also cause some browning in areas that were applied and left the longest before rinsing. The invention based formula performed identically to the control formula for road film removal in all vehicles tested. Road film was finally and easily removed via a second step alkaline cleaner formulation shown in Table 5 below and applied at a dilution rate of 30:1 with water. (WinSurf Q3™ nonionic surfactant, with excellent wetting properties, is available from Win Chemicals Ltd. and Vitech International, Inc.). There was no difference in ease of road film removal in the HF formula or invention based formula. Alternatively, an improved finish is observed using 7.5% tetrafluoroboric acid, 3.5% sulfuric acid (98%) and 5.8% urea.

TABLE 5

Formulae Tested for Second Step Aluminum Brightening

| Control | Invention |
|---|---|
| 2% Metso penta bead | 2% Metso penta bead |
| 4% NTA crystal | 4% NTA crystal |
| 0.5% Sodium Hydroxide | 0.5% Sodium Hydroxide |
| 4.0% WinSurf Q3 ™ surfactant | 4.0% WinSurf Q3 ™ surfactant |
| QS water | QS water |
| Apply at 30:1 | Apply at 30:1 |

TABLE 6

Formulae Tested for First Step Road Film Removal

| Control | Invention |
|---|---|
| 20% Phosphoric acid (85%) | 5.0% tetrafluoroboric acid (48%) |
| 3.0% WinSurf Q3 ™ surfactant | 2.6% Sulfuric acid (98%) |
| QS water | 3.0% WinSurf Q3 ™ surfactant |
| Apply at 100:1 | 4.0% Urea |
| | 0.03% Armohib 28 ® inhibitor |
| | QS Water |
| | Apply at 100:1 |

TABLE 7

Formulae Tested for Second Step Road Film Removal

| Control | Invention |
|---|---|
| 3% Metso penta bead | 3% Metso penta bead |
| 6% NTA crystal | 6% NTA crystal |
| 1.0% Sodium Hydroxide | 1.0% Sodium Hydroxide |
| 6.0% WinSurf Q3 ™ surfactant | 6.0% WinSurf Q3 ™ surfactant |
| QS water | QS water |
| Apply at 60:1 | Apply at 60:1 |

In touchless car washing, HF is seldom used except perhaps on wheels only, due to its aggressiveness toward glass. Phosphoric acid is a well accepted acid in this application, although there are environmental issues associated with phosphorus content. Both the phosphoric acid and invention based formulae were applied at 100:1 dilution rates with water. A dwell time of approximately 20 seconds was allowed until application of the second alkaline step (identical formula and dilution rates).

The invention based formula provided superior cleaning of windshield eyebrow, and particularly gave better removal of road film. This was evaluated visually and was best seen on black cars. A simple test to look at road film removal is to make a one to two inch mark with the finger as the vehicle comes out from the car wash bay. If road film is still on the vehicle, one will see the paint as darker on the mark. If road film is removed completely, no mark will be evident. In the case of the invention, no marks could be seen on any of the cars tested.

TABLE 8

| Formulae Tested for Wheel Cleaning | |
|---|---|
| Control | Invention |
| 5.0% Hydrofluoric acid (48%) | 10% tetrafluoroboric acid (48%) |
| 5.0% Sulfuric acid | 7% Sulfuric acid (60%) |
| 3.0% WinSurf Q3 ™ surfactant | 3.0% WinSurf Q3 ™ surfactant |
| QS water | 7.0% Urea |
| Apply as is | 0.05% Armohib 28 ® inhibitor |
| | QS Water |
| | Apply as is |

Testing of each wheel cleaner solution was performed on front and back wheels of several vehicles ranging in brake dust soiling conditions. In each case, the drivers side front and back wheels were tested with the invention based formula, and the passenger side wheels were tested with the control. This is done since the front wheels tend to be the most difficult to clean. In all cases, the formula was simply sprayed onto the wheel, allowed to sit for three minutes and then pressure washed from off of the wheel at a pressure of 1500 psi and a flow rate of 2 gallons/minute. Wheels were then left to dry.

Results of the testing showed comparable results between the two formulations. It was noticed that there was far less odour when applying the invention based formula. Both formulae completely removed brake dust and there was no film left on the wheels after cleaning.

Example 3

The following compositions can be prepared for use, as indicated. Percentages are by weight and can be varied for a particular application.

Example 4a

Intractable Water Spot Remover

20% tetrafluoroboric acid (48%)
10% Urea
0.5% WinSurf Q3™ surfactant
0.04% Armohib 28® inhibitor
QS Water
Use as is to 5× dilution Example 4b Fallout Remover 15% tetrafluoroboric acid (48%)
6.0% Urea
1.5% WinSurf Q3™ surfactant
0.05% Armohib 28® inhibitor
QS Water
Use as is Example 4c Car Wash Bay Cleaner 20% tetrafluoroboric acid (48%)
9.0% Urea
2.75% WinSurf Q3™ surfactant
0.04% Armohib 28® inhibitor
QS Water
Use at about 10-60:1 dilution rate Example 4d Jewelry Cleaner 17.5% tetrafluoroboric acid (48%)
7.5% Urea
0.25% WinSurf Q3™ surfactant
0.1% Armohib 28a) inhibitor
QS Water Use as is. With soaking for 15-90 seconds, this cleaner will remove black silver oxide tarnish from jewelry and allows for a non-abrasive (frictionless) technique to be used that further cuts down on labour. Longer times may be needed for severe tarnish.

Example 4e

CLR Cleaner

8% tetrafluoroboric acid (48%)
3.0% Urea
0.25% WinSurf Q3™ surfactant
0.03% Armohib 28®& inhibitor
QS Water
Use as is

I claim:

1. A method for removing surface contaminants, said method comprising:

providing an aqueous composition comprising a compound, said compound the acid-base reaction product of tetrafluoroboric acid and urea, said urea and said tetrafluoroboric acid in a molar ratio of about 1.0 to about 3.0, said urea utilized as a base and dissolved in said composition; and contacting said composition and a surface comprising at least one contaminant thereon.

2. The method of claim 1 wherein said composition comprises a surfactant.

3. The method of claim 1 wherein said surface is selected from automotive surfaces, said contact removing contaminants selected from road film, metal oxides, brake dust and combinations thereof.

4. The method of claim 3 wherein said contact is substantially absent surface corrosion.

* * * * *